United States Patent [19]

Regan

[11] Patent Number: 4,653,680

[45] Date of Patent: Mar. 31, 1987

[54] APPARATUS FOR BREAKING SEMICONDUCTOR WAFERS AND THE LIKE

[76] Inventor: Barrie F. Regan, 2260 Redington Rd., Hillsborough, Calif. 94010

[21] Appl. No.: 727,277

[22] Filed: Apr. 25, 1985

[51] Int. Cl.[4] ..... B26F 3/00

[52] U.S. Cl. ..... 225/104; 125/23 R; 225/103

[58] Field of Search ..... 225/2, 96.5, 104, 103; 125/23 R, 30 R, 35

[56] References Cited

U.S. PATENT DOCUMENTS

| | | | |
|---|---|---|---|
| 3,497,948 | 3/1970 | Wiesler et al. | 225/2 X |
| 3,562,057 | 2/1971 | McAlister et al. | 225/2 X |
| 3,565,306 | 2/1971 | St Louis | 225/2 X |
| 3,570,733 | 3/1971 | Allen | 225/104 |
| 3,687,345 | 8/1972 | Carlson et al. | 225/2 X |
| 3,790,051 | 2/1974 | Moore | 225/2 X |
| 4,068,788 | 1/1978 | Gubitose et al. | 225/2 X |

*Primary Examiner*—Frank T. Yost

*Attorney, Agent, or Firm*—Limbach, Limbach & Sutton

[57] ABSTRACT

Apparatus and method for breaking a scribed semiconductor wafer and the like. The apparatus includes a wafer support which is movable with respect to a breaker arm having a knife-edge. The breaker arm is actuated pneumatically or by other similar means to impart a shock or impulse to the wafer along each of the wafer scribe lines so as to fracture the wafer. A control mechanism is provided for automatically alternately stepping the wafer position with respect to the breaker arm and actuating the breaker arm. Once the entire wafer has been broken along one axis, the wafer is rotated ninety degrees and the sequence is repeated along the other axis.

24 Claims, 9 Drawing Figures

APPARATUS FOR BREAKING SEMICONDUCTOR WAFERS AND THE LIKE

BACKGROUND OF THE INVENTION

1. Field of the Invention

The present invention relates generally to the field of materials processing and more particularly to an apparatus and method for breaking scribed semiconductor wafers and the like into individual die.

2. Background Art

In the manufacture of microelectronic devices, such as integrated circuits, several hundred or more devices are fabricated on a single semiconductor wafer. The wafer is scribed and broken into individual die utilizing a semiconductor wafer breaker, with each die comprising a single circuit.

A popular wafer breaker is disclosed in U.S. Pat. No. 3,920,168 entitled "Apparatus for Breaking Semiconductor Wafers" naming the present inventor as a co-inventor. Another approach is to position the wafer on a thin stretchable film. The wafer is then turned over and placed on a rubber pad. A roller breaker is rolled over the film causing the wafer to break along the scribe lines.

The art of semiconductor technology has advanced to the point that extremely small devices can now be fabricated on a wafer. Such devices may be on the order of a cube 0.005 inches in size. The present inventor is not aware of any conventional wafer breaking apparatus or method which is capable of successfully breaking such small devices.

The subject invention overcomes the above-noted limitations of conventional wafer breakers and is capable of breaking such extremely small devices with a high yield. Breaking is achieved with essentially no chipping, hinging or side damage. The apparatus may be utilized with wafers fabricated from a wide range of materials, including silicon and galium and wafers having metalized backings. In addition, wafers having delicate metalization patterns, such as interdigitated metalization patterns or air bridge constructions can be broken without damage.

These and other advantages of the present invention will become apparent to persons having ordinary skill in the art upon a reading of the following Best Mode for Carrying Out the Invention, together with the drawings.

DISCLOSURE OF THE INVENTION

An apparatus and method for breaking a segment of relatively hard sheet material, such as a semiconductor wafer, along a plurality of parallel and spaced-apart break lines is disclosed.

The apparatus includes a segment support which preferably includes a film on which the segment is mounted. The film is supported around the periphery thereof by a rigid support element, such as support ring.

The apparatus further includes breaker means for imparting a shock to the segment which is distributed along the segment break lines. The breaker means preferably includes a breaker bar having a knife-edge which applies a force to the segment through the film. The force is preferably an impulse which imparts a shock to the segment so as to produce a fracture.

A drive means is further provided for causing the breaker means to fracture the segment along each of the break lines. The drive means preferably automatically alternately steps the position of the segment with respect to the breaker means and actuates the breaker means so that the breaking force is applied to the segment.

BEST MODE FOR CARRYING OUT THE INVENTION

Figure 1:
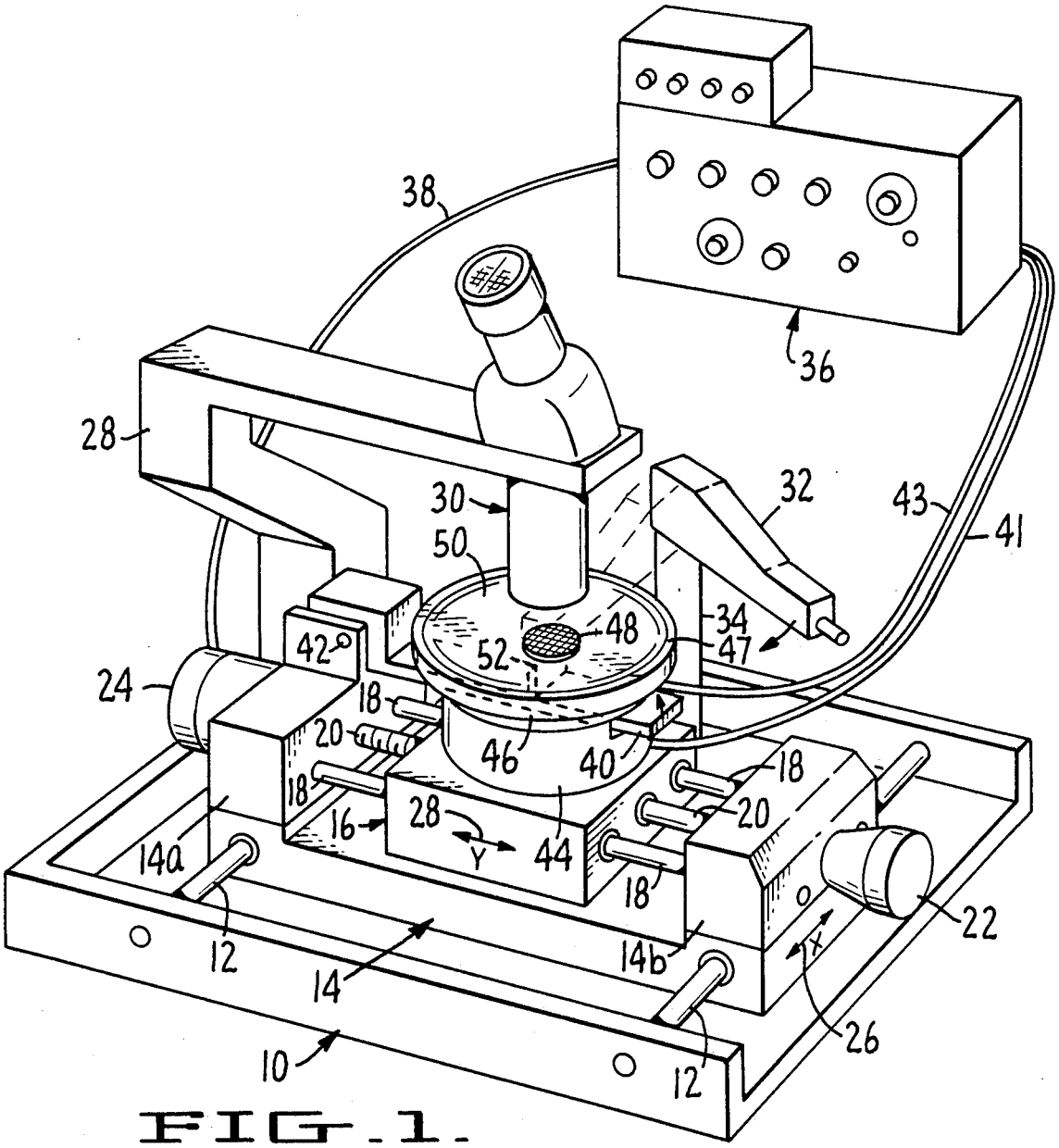
FIG. 1 is a perspective view of a first embodiment of the subject invention.
Figure 2:
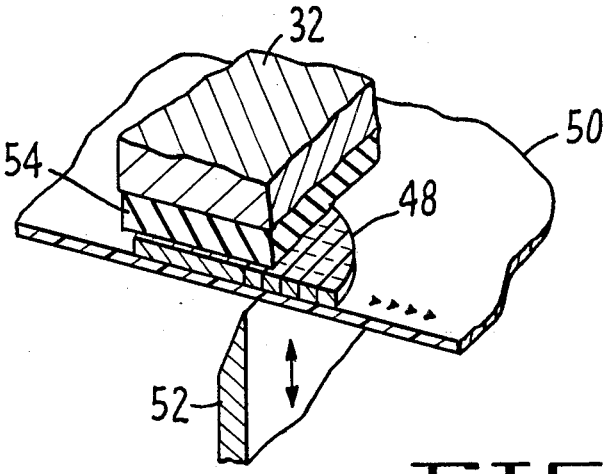
FIG. 2 is an enlarged fragmentary view of the subject invention showing a segment of a semiconductor wafer to be broken disposed between the breaker bar and anvil arm.
Figure 3:
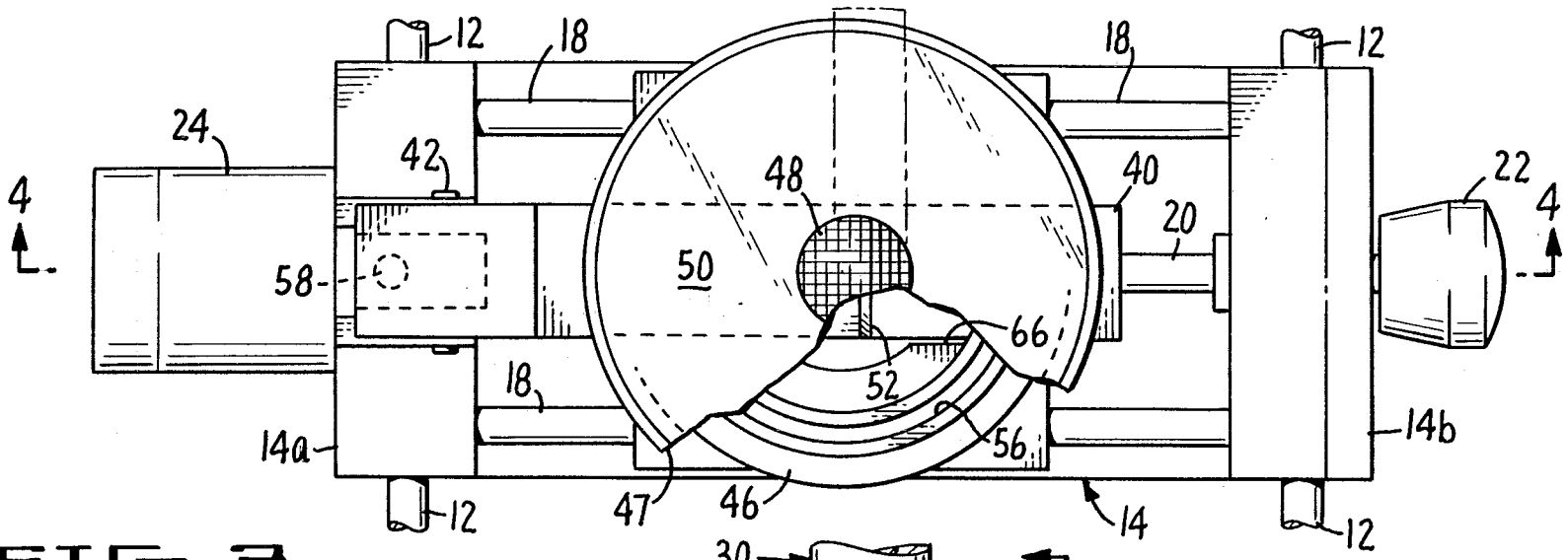
FIG. 3 is a top plan view of the first embodiment of the subject invention.

Referring now to the drawings, a first embodiment of the invention is depicted in FIGS. 1-6. The wafer breaker is provided with a rigid main frame 10 which rests on a flat work surface. Frame 10 includes a vertical flange (not designated) which extends around three sides of the rectangular base of the frame.

A base mount, generally designated by the numeral 14, is mounted above frame 10 on a pair of spaced-apart guide rails 12. The guide rails, which are secured to opposite flanges of the frame, extend through openings formed at opposite ends of mount 14. Linear bearings (not shown) are provided so that the base mount may be manually shifted back and forth along an X axis, as represented by arrow 26.

Base mount 14 includes a pair of opposing end members **14*a* and 14*b* which define a channel therebetween. A wafer mount, generally designated by the numeral 16, is positioned above the base mount within the channel. A pair of spaced-apart guide rails 18 are mounted on end members 14*a* and 14*b* at right angles with respect to rails 12. Rails 18 extend through openings in wafer mount 16**, with the mount being supported on linear bearings (not shown).

Figure 4:
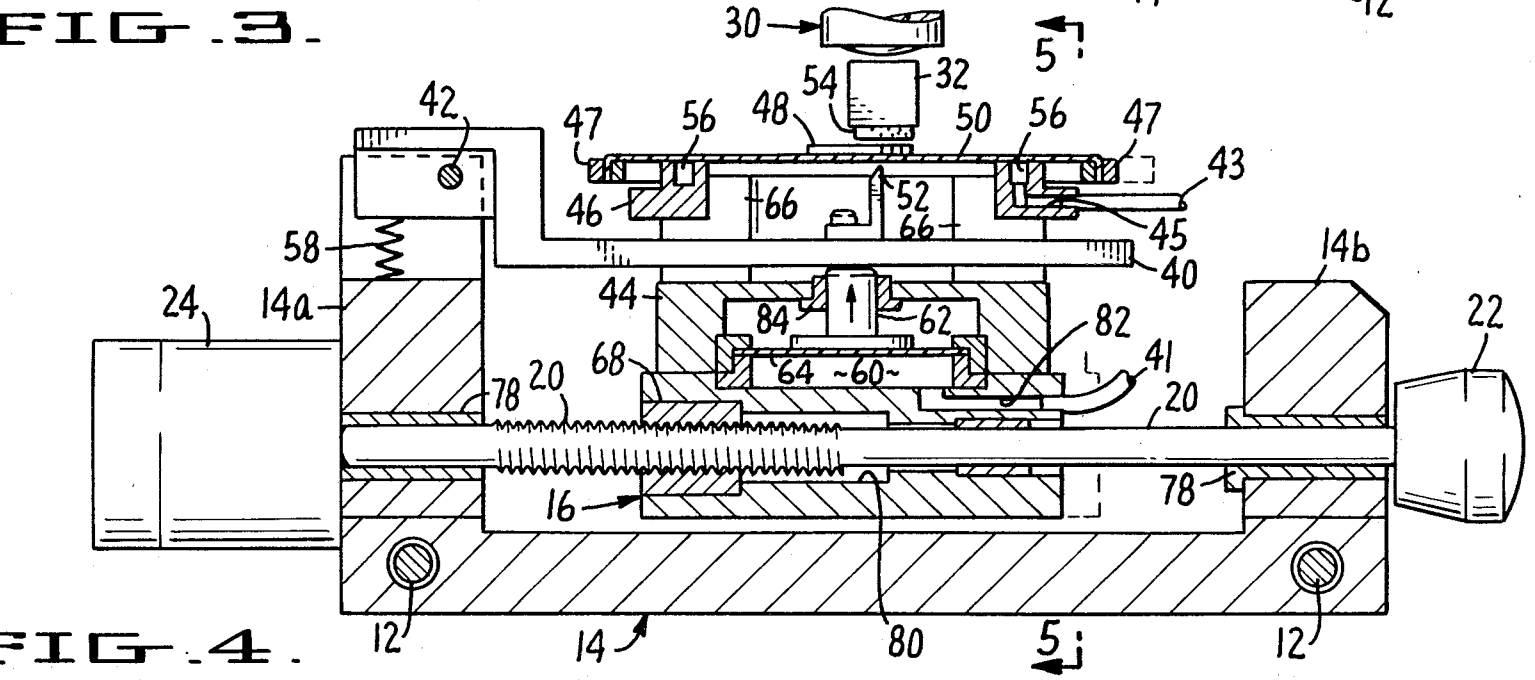
FIG. 4 is a cross-sectional side elevational view taken through section line 4—4 of FIG. 3.

As can best be seen in FIG. 4, a lead screw 20 is rotatably mounted on journals 78 located in openings formed in end members **14*a* and 14*b*. Screw 20 is positioned between, and parallel with, guide rails 18. The screw extends through a central bore 80 located in wafer mount 16 and engages a threaded insert 68** secured within the bore.

A knob 22 is fastened at one end of screw 20 adjacent end member **14*b*. The remaining end of the screw is secured to the drive shaft (not shown) of a conventional stepper motor 24. The housing of motor 24 is mounted on end member 14*a***.

Wafer mount 16 may be driven along a Y axis, represented by line 28 (FIG. 1), as a result of manual rotation of knob 22 or in response to actuation of motor 24. Thus, wafer mount 16 may be translated in both the X axis and Y axis directions.

Wafer mount 16 carries an impulse assembly 44. As can best be seen in FIGS. 4 and 6, assembly 44 is cylindrically shaped and is provided with upper and lower coaxial bores separated by a horizontal partition (not designated). A rectangular channel 66 extends through the upper section of assembly 44, parallel to guide rails 18. An annular shelf 70 is formed around the upper periphery of the assembly for receiving a vacuum ring 46.

As can best be seen in FIG. 4, the lower bore of assembly 44 contains a pneumatic impulse mechanism, which includes a pressure diaphragm 64. Diaphragm 64, together with the bottom of the lower bore, defines a pressure chamber 60. An air inlet 82 is formed in the assembly which is in communication with chamber 60. The air inlet is coupled to an air line 41 which, as will be subsequently described, is connected to a compressed air source.

An opening is formed in the center of the horizontal partition of assembly 44, having a bushing 84 inserted therein. An impulse plunger 62 is secured to the top surface of diaphragm 64, with the plunger extending through bushing 84 up into the upper bore. When a burst of compressed air is delivered to chamber 60, plunger 62 is driven upwards into the upper bore of the assembly, as diaphragm 64 expands.

An impulse arm 40 is provided which is driven by plunger 62. One end of arm 40 is pivotally mounted on end member **14*a* of base mount 14 by way of a pivot pin 42. As can be seen in FIG. 4, a recess is formed in member 14*a* below the end of arm 40 for receiving a spring 58**.

The central portion of impulse arm 40 extends through channel 66 of impulse assembly 44, in a position which is qenerally parallel within guide rails 18. Arm 40 is free to move vertically within channel 66 when driven by plunger 62.

A breaker bar 52, preferably fabricated from tool steel, is rigidly mounted on the top surface of impulse arm 40, within channel 66 of the impulse assembly. Breaker bar 52 has a generally L-shaped cross-section, with a horizontal segment positioned on arm 40 and a vertical segment which terminates at the upper periphery thereof in a knife-edge. The bar preferably has a width at least as great as, and preferably greater than, the diameter of the largest wafer to be broken.

Vacuum ring 46 is fitted over the top of impulse assembly 44, with the lower surface of the ring resting on shelf 70. The inner diameter of the ring is typically approximately 2 inches greater than the width of the breaker bar. A circular vacuum groove 56 is formed on ring 46 which extends around the periphery of the ring. An air inlet 45 extends from the edge of the ring into the bottom of groove 56. An air line 43 is coupled to inlet 45 so that a vacuum may be formed in groove 56. As can best be seen in FIG. 4, the upper edge of breaker bar 52 preferably is aligned with the top surface of vacuum ring 46 when the ring is positioned over impulse assembly 44.

The wafer 48 to be broken is supported on a thin polymer film 50 which is stretched over a support ring 47. The upper surface of film 50 preferably has a thin adhesive coating which is slightly tacky. The tacky surface serves to hold the wafer in place, including the individual broken die. There are commercially available adhesive tapes which are suitable for this application, including a stretchable vinyl tape sold under the brand name NITO.

Support ring 47 preferably is comprised of an inner ring section and an outer ring section which snaps over the inner section. Film 50 is first stretched over the inner ring section and the outer ring section is then placed over the film and snapped in place, with the film being gripped between the two sections.

Once the wafer 48 has been positioned at the center of film 50 with the scribed surface up, the assembly is placed over vacuum ring 46. The film seals the vacuum groove 56 so that a vacuum may be formed utilizing vacuum line 43, thereby securing the wafer in place. As can best be seen in FIG. 4, wafer 48 is suspended on film 50 over breaker bar 52 with the nonrigid film serving to mechanically isolate the wafer from the vacuum ring 46 and other surrounding rigid structure.

Figure 5:
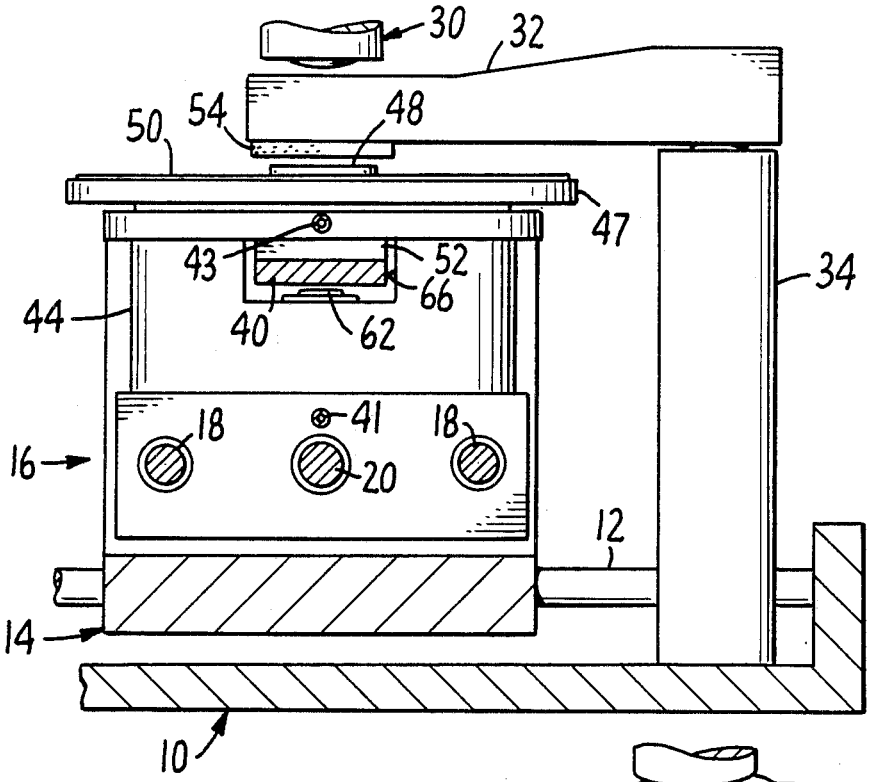
FIG. 5 is a cross-sectional front elevational view of the invention taken through section line 5—5 of FIG. 4.
Figure 6:
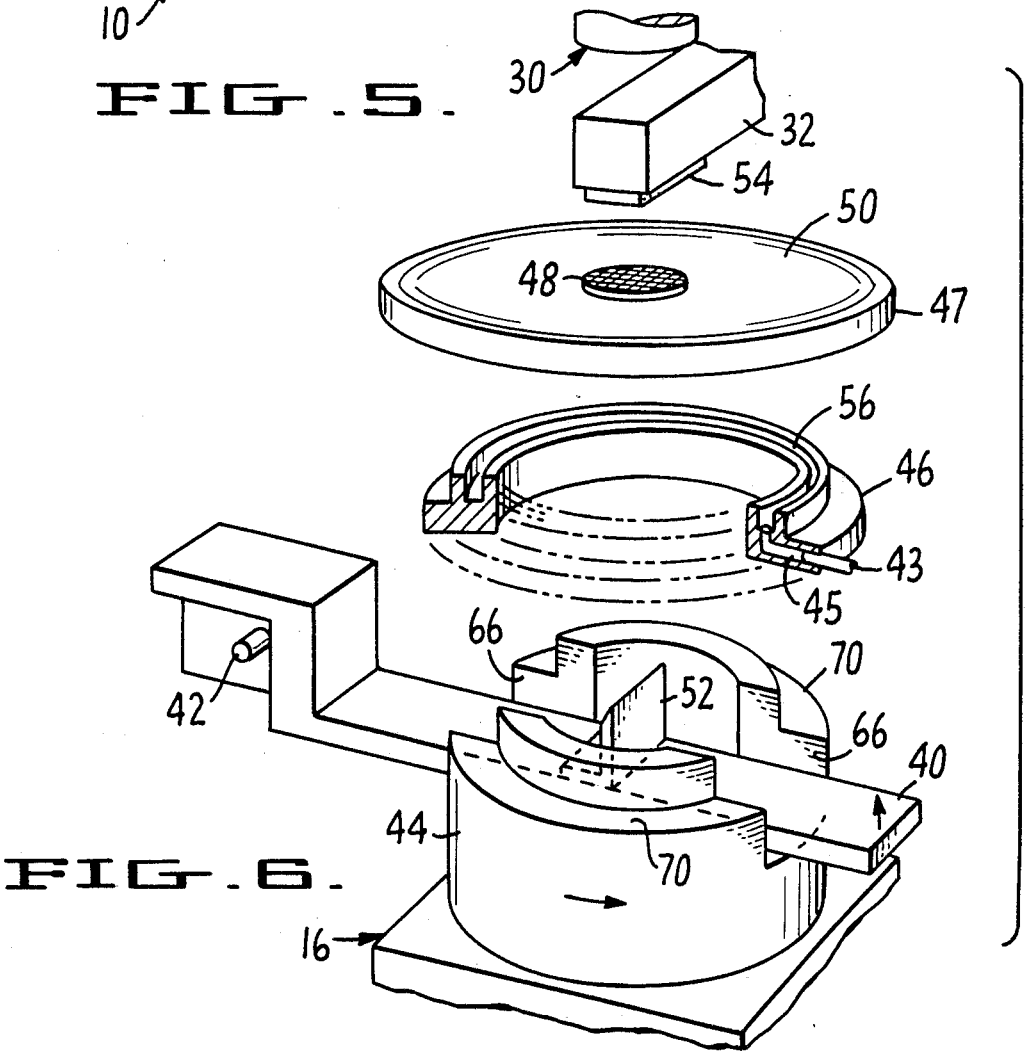
FIG. 6 is an exploded perspective view of the first embodiment of the invention showing some of the details of the breaker bar, impulse arm and associated apparatus.

As shown in FIGS. 1 and 5, an anvil arm 32 is pivotally mounted on a vertical pedestal 34. Pedestal 34 is, in turn, rigidly secured to frame 10. Anvil arm 32 may be manually pivoted in a horizontal plane between a swing-away position, as depicted in FIG. 1, and an operate position, as depicted in FIG. 5.

When arm 32 is in the operate position, the arm is located directly above breaker bar 52 and displaced slightly above wafer 48. A resilient pad 54, preferably fabricated from rubber or the like, is secured to the underside of arm 32 to provide cushioning. As will be subsequently described, arm 32 serves to limit vertical displacement of wafer 48 during the breaking sequence.

The wafer breaker further includes a microscope, generally designated by the numeral 30, which is supported over the breaker bar 52 on a pedestal 28. Pedestal 28 is rigidly secured to frame 10. The objective lens (not designated) of the microscope is spaced apart from wafer 48 a sufficient distance to permit anvil arm 32 to be pivoted between the microscope and wafer when the arm is in the operate position.

Microscope 30 has a reticle which is used to align wafer 48, as will be subsequently explained. The microscope also can be used for other purposes, such as inspecting the wafer and the like.

Conventional control apparatus, generally designated by the numeral 36, is utilized for driving and otherwise controlling the subject wafer breaker. Apparatus 36 provides appropriate electrical signals on line 38 for driving stepper motor 24. As previously described, line 43 is coupled to the control apparatus and provides a vacuum for vacuum ring 46. Line 41, also coupled to the control apparatus, provides compressed air for actuating impulse assembly 44. Immediately after actuation, chamber 60 is evacuated through line 41 so that impulse plunger is returned to a retracted position.

Having described the construction of the first embodiment of the subject invention, operation of the invention will now be described. Anvil arm 32 is first pivoted to the swing-away position and wafer mount 16 is shifted to a home position by rotation of lead screw 20. Screw 20 may be driven manually using knob 22 or may be driven by way of motor 24 by single stepping the motor utilizing control apparatus 36.

Vacuum ring 46 is removed from the impulse assembly 44 and base mount 14 is manually shifted on guide rails 12 along the X axis so that breaker bar 52 may be observed through microscope 30. The operator notes the position of the knife-edge of bar 52 utilizing the microscope reticle.

The wafer is scribed or cut with a diamond slicing blade in the conventional manner. Film 50 is secured on support ring 47, between the two ring sections. The wafer is positioned in the center of the film 50 on the tacky side of the film, with the scribed side of the wafer facing up. The base mount 14 is then moved towards the operator along rails 12 so as to provide access to the top of the impulse assembly 44. Support ring 47 is then placed over the assembly, with film 50 sealing groove 56 of vacuum ring 46. The appropriate control is actuated on control apparatus 36 so as to apply a vacuum to vacuum ring 46, thereby securing the film and wafer to the impulse assembly. The portion of film 50 on which the wafer is mounted is displaced a substantial distance from supporting vacuum ring 46 so as to provide mechanical isolation, as previously noted.

The base mount 14 is then shifted away from the operator and positioned over the breaker bar in the home position. Vacuum ring 46 is rotated on impulse assembly 44 until one set of wafer scribe lines is parallel with the edge of breaker bar 52. The microscope reticle is used for this purpose since the breaker bar can no longer be observed.

Control apparatus 36 is then set to index or step motor 24 a predetermined amount, depending upon the spacing between the aligned scribe lines of the wafer. Rotation of the motor 24 drive shaft and lead screw 20 will cause wafer mount 14 to translate along the Y axis on guide rails 18. The wafer mount is then positioned utilizing knob 22 or control apparatus 36 until the knife-edge of the breaker bar is positioned precisely under the wafer scribe line located at an extreme edge of the wafer. Again, since the bar cannot be observed, it is necessary to utilize the microscope reticle.

Motor 24 is then single stepped a few times to verify that, when the wafer is indexed, the wafer scribe lines are precisely positioned over the breaker bar knife-edge. Once it is confirmed that the wafer is properly aligned and the step size is correct, the wafer is repositioned, with the scribe line at the extreme edge of the wafer positioned over breaker bar.

Control apparatus 36 is implemented to carry out the breaking sequence automatically. The apparatus first causes the stepper motor to step which results in the wafer being indexed. Once the step is completed, an internal solenoid in apparatus 36 is actuated thereby causing a quantity of compressed air to be delivered to impulse assembly 44 through line 41. The pressure chamber 60 is then immediately evacuated to atmosphere through the line.

As previously described, the inrush of air causes diaphragm 64 to expand, driving impulse plunger 62 upwards. The plunger strikes pivotally-mounted impulse arm 40 which carries breaker arm 52, thereby causing spring 58 to compress. The breaker arm is driven upwards striking the underside of wafer 48, through film 50, immediately below a scribe line. A shock or impulse is imparted to the wafer, fracturing any metalized undercoating and causing the wafer to fracture cleanly along the scribe line.

As the break occurs, upward movement of wafer 48 is restricted by anvil arm 32. Resilient pad 54 prevents damage to the wafer. Next, the pressure chamber is immediately evacuated to atmosphere through line 41, causing the impulse plunger 62 to retract. Impulse arm 40 then returns to the normal position by virtue of spring 58.

Once the impulse plunger 62 has retracted, control apparatus 36 automatically causes the wafer to be indexed to the next scribe line by stepping motor 24. The impulse plunger is again actuated by an inrush of air followed by an evacuation so as to fracture the wafer along the next scribe line. This sequence is automatically repeated until the entire wafer is broken along a first axis.

The fractured wafer, which is held together by tacky film 50, is then broken along the second axis. First, vacuum ring 46 is rotated ninety degrees so that the second wafer axis is aligned with the knife-edge of breaker bar 52. Unless the individual die are square, it will be necessary to change the step size by appropriate adjustment of control apparatus 36. The wafer is then broken along the second axis in the same manner as previously described in connection with the first axis.

The broken wafer 48, vacuum ring 46 and film 50 may then be removed from the apparatus as an entire unit, with the tacky film holding the individual die in place. The ring and film may be used as a carrier during further processing of the die, such as inspection and electrical testing. In addition, the broken wafer may be expanded by stretching the film so as to separate the individual die so that the die may be easily removed from the film.

Control apparatus 36 permits the speed of the breaking operation to be adjusted, as required. It may also be necessary to control the air pressure driving the impulse assembly 44, depending on various factors such as the thickness of the wafer, the type of semiconductor material, and the presence of a metalized backing.

Unlike conventional wafer breaking apparatus, the present invention permits visual inspection of the wafer throughout the entire breaking sequence and allows for easy alignment. The wafer is always facing up during the operation and remains flat rather than being bent or arched. In addition, the breaking operation may be stopped at any time to check alignment or make other modifications and then restarted.

Figure 7:
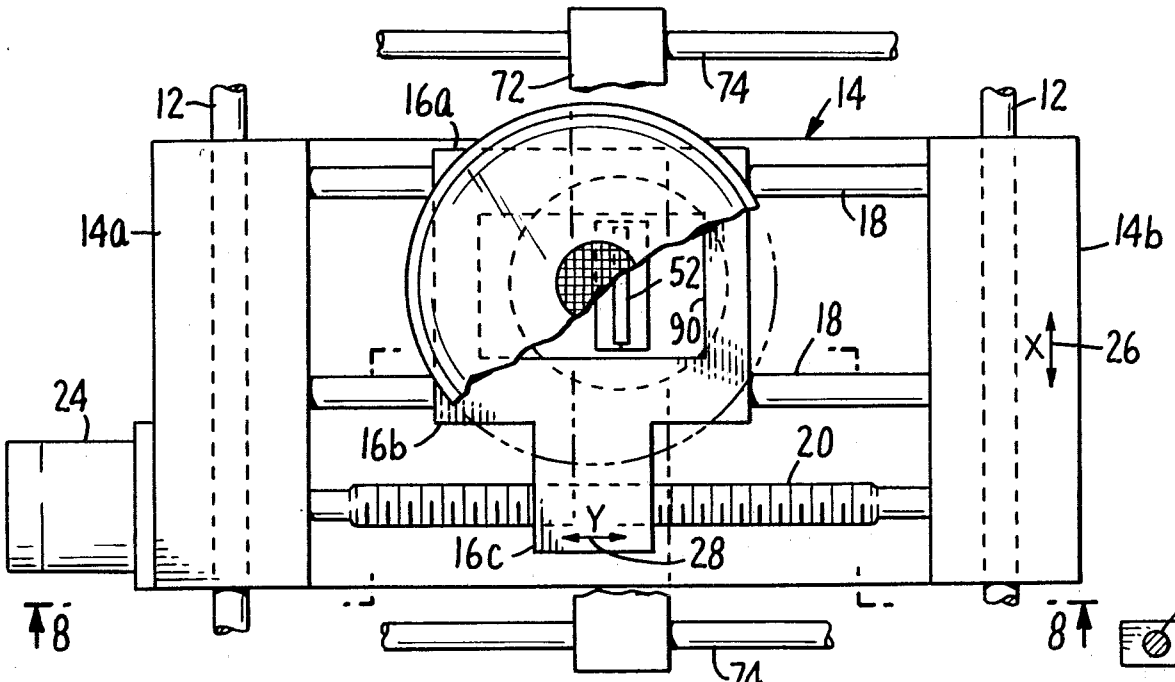
FIG. 7 is a partial top plan view of a second embodiment of the subject invention.
Figure 9:
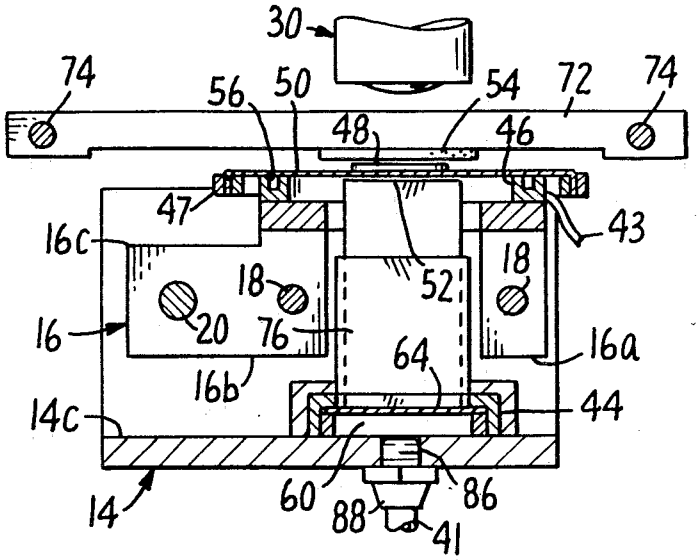
FIG. 9 is a cross-sectional front elevational view taken through section line 9—9 of FIG. 8.
Figure 8:
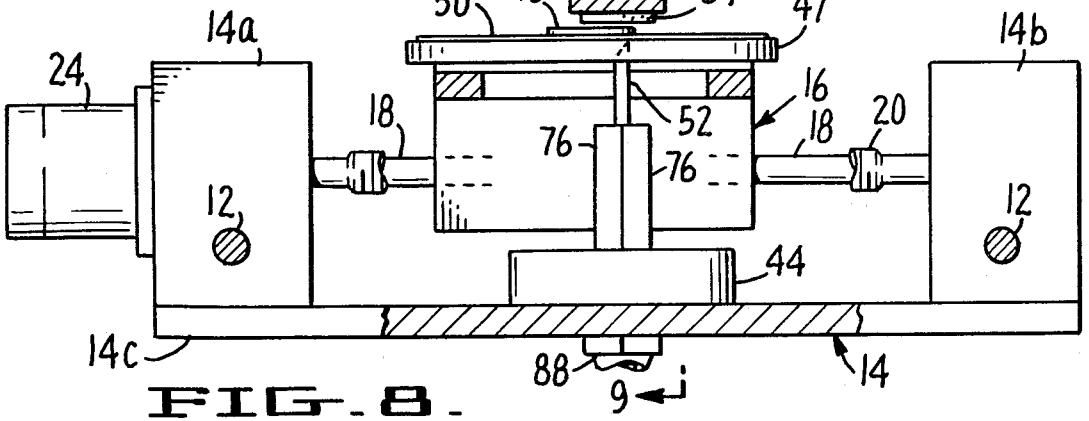
FIG. 8 is a cross-sectional side elevational view of the invention taken through section line 8—8 of FIG. 7.

A second embodiment of the subject invention will now be described in connection with FIGS. 7–9. Corresponding components of the first and second embodiments are designated with the same numerals. The second embodiment is provided with a frame (not shown) and mounted a microscope 30, similar to frame 10 and microscope 30, respectively, of the first embodiment. A base mount, generally designated by the numeral 14, is mounted on guide rails 12 to permit manual movement of the base mount on the frame in the same manner previously described in connection with the first embodiment breaker. Movement is along an X axis, as represented by arrow 26.

Base mount 14 includes a pair of opposing end members **14*a* and 14*b* mounted at opposite ends of a bottom panel 14*c*. An impulse assembly 44 is mounted on top of panel 14*c*. The assembly has a housing (not designated) which encloses an air chamber 60, defined primarily by a diaphragm 64 and the bottom of the panel 14*c***.

An air inlet 86 is formed in panel **14*c* which is in communication with chamber 60. The inlet is coupled to an air line 41 through a coupling 88 mounted on the underside of panel 14*c*. Air line 41 is connected to a control apparatus (not shown), identical to apparatus 36** of the first embodiment.

A breaker bar 52 is secured to the top surface of diaphragm 64 which extends upwards, through an opening in the impulse assembly housing. Breaker bar 52 is supported on the diaphragm by a pair of vertical support members 76 located on opposite sides of the bar. A knife-edge is formed at the top of bar 52 similar to the edge formed in the first embodiment bar.

A wafer mount, generally designated by the numeral 16, is supported between end member 14*a* and 14*b* and above bottom panel 14*c*. Mount 16 is provided with a pair of spaced-apart wall sections 16*a* and 16*b* having openings for slideably receiving guide rails 18. Guide rails 18 are supported, at respective ends thereof, by end members 14*a* and 14*b*. Linear bearings are provided within the wall section openings so that wafer mount 16 may be driven smoothly along the guide rails. Wall sections 16*a* and 16*b* are connected together by cross members (not designated) to form a unitary structure.

A lead screw 20 is rotatably mounted between end members 14*a* and 14*b*, parallel with guide rails 18 and outboard of the rails. One end of screw 20 is connected to the drive shaft of a stepper motor 24, with the motor being mounted on end member 14*a*. Motor 24 is driven by the control apparatus in the same manner as previously described in connection with the first embodiment.

Wafer mount 16 is provided with an extension member 16*c* which projects from wall section 16*b*. Member 16*c* has a central bore which receives lead screw 20. A threaded insert (not shown) is secured within the bore which engages the threads of screw 20. Thus, when motor 24 rotates screw 20, wafer mount 16 is driven on guide rails 18 along the Y axis, as represented by arrow 28.

A vacuum ring 46, similar to ring 46 of the first embodiment, is mounted on the upper portion of wafer mount 16. The ring includes a vacuum groove 56 in communication with an air line 43 which provides a vacuum for securing a film 50 and associated support ring 47. The top surface of vacuum ring 46 coincides with the knife-edge of breaker bar 52.

A sliding anvil arm 72 is mounted above the impulse assembly 44 on a pair of guide rails 74. The guide rails 74 are parallel with rails 18 and are supported above the main frame by a pair of mounting members (not shown) rigidly secured to the frame. Openings are formed at opposite ends of anvil arm 72 to receive rails 74. Linear bearings are utilized so that the anvil arm may be manually shifted from side to side along the Y axis, below microscope 30. Arm 72 includes a resilient pad 54 secured to the underside of the arm. When the arm is positioned above wafer 48, the arm is slightly displaced from the wafer, as with the first embodiment apparatus.

Because screw 20 is positioned outboard of guide rails 18, it is possible to locate the impulse assembly 44 on base mount 14, rather than on wafer mount 16, as was the case with the first embodiment apparatus. As a result, the impulse assembly is stationary with respect to anvil arm 72 during the breaking sequence; therefore, there is no requirement for an intermediate impulse arm, such as arm 40 of the first embodiment.

Operation of the second embodiment apparatus is similar to that of the first embodiment. The sliding anvil arm 72 is first moved to one side so that breaker bar 52 can be viewed through the microscope 30. The impulse assembly 44 is set to a home position by moving base mount 14 and wafer mount 16, as required. Next, the precise position of the breaker bar knife-edge is noted utilizing the microscope reticle.

Once the breaker bar position has been noted, wafer mount 14 is shifted toward the operator, along the X axis. The two-part support ring 47, carrying film 50 and the wafer 48 to be broken, is then positioned on wafer mount 16. Base mount 14 is then returned to the home position and the support ring 47 is rotated until one set of wafer scribe lines is aligned with the breaker arm 52 knife-edge utilizing the microscope reticle. A vacuum is then applied to vacuum ring 46, by actuating the appropriate control on apparatus 36, thereby securing the wafer 48 in place.

The step size is then set on control apparatus 36 in accordance with the wafer scribe line spacing. The scribe line on an extreme edge of wafer 48 is then positioned precisely over the knife-edge of breaker bar 52. The stepper motor 24 is then manually stepped a few times to verify that the wafer is being indexed the proper distance.

The wafer mount 16 is then returned to the home position and anvil arm 72 is positioned over breaker arm 52. The breaking sequence is then commenced, with control apparatus 36 alternately indexing the wafer mount and actuating the impulse assembly. Once each scribe line has been broken along one axis, the wafer is rotated ninety degrees and the process is repeated.

The present invention is intended primarily for use in breaking scribed semiconductor wafers. However, the invention is suitable for use in breaking other products having physical characteristics similar to that of semiconductor wafers. In some instances, it is anticipated that the present breaker apparatus and method may also be utilized for breaking products along predetermined break lines where, by virtue of the crystalline structure of such products, scribing or otherwise cutting the product along the break lines is not required prior to breaking. It is also anticipated that the subject apparatus will be useful in breaking products along a single axis rather than orthogonal axes.

Thus, a novel apparatus and method for breaking semiconductor wafers and the like have been disclosed. Although two embodiments of the apparatus have been described in some detail, it is to be understood that various modifications could be made by persons skilled in the art without departing from the spirit and scope of the invention as defined by the appended claims.

I claim:

1. Apparatus for breaking a segment of relatively hard sheet material along a plurality of parallel and spaced-apart break lines, said apparatus comprising:

support means for supporting the segment at least prior to breaking, said support means including a relatively rigid support element and a relatively non-rigid support element;

breaker means for imparting a shock to the segment which is distributed along a first one of the break lines so as to fracture the segment along the first break line, said breaker means including a breaker bar having a knife-edge which imparts said shock through said non-rigid support element along substantially the entire length of the break lines;

anvil means for restricting displacement of the segment when said shock is imparted to the segment; and drive means for causing said breaker means to fracture the segment along a second one the break lines, adjacent the first break line.

2. The apparatus of claim 1 wherein said non-rigid element is in the form of a film.

3. The apparatus of claim 2 wherein said film includes a segment-mounting area for mounting the segment and said rigid support element supports said film at locations displaced from said segment mounting area.

4. The apparatus of claim 3 wherein said rigid support means supports said film along substantially the entire periphery of said film.

5. The apparatus of claim 4 wherein said film includes an adhesive layer for securing the segment.

6. The apparatus of claim 5 wherein said anvil means includes an anvil member and said film is disposed between said breaker bar and said anvil member.

7. The apparatus of claim 6 wherein said anvil member includes a resilient pad for contacting the segment.

8. The apparatus of claim 7 wherein said anvil member is movable between a first position disposed proximate said segment mounting area and a second position displaced from said first position.

9. Apparatus for breaking a segment of relatively hard sheet material along a plurality of parallel and spaced-apart break lines, said apparatus comprising:

support means for supporting the segment, said support means including a relatively rigid support element and a relatively non-rigid support element;

breaker means for applying an impulse to the segment along a first one of the break lines so as to fracture the segment along the first break line, said breaker means including a breaker bar having a knife-edge which applies said impulse to the segment through said non-rigid support element;

anvil means for limiting movement of the segment; and drive means for causing said breaker means to fracture the segment along each of the break lines, wherein said drive means includes stepper means for sequentially steppping the relative positions of the segment and said breaker bar such that said knife-edge is disposed opposite each of the break lines and actuating means for actuating said breaker means so as to cause said breaker bar to apply said impulse to the segment through said non-rigid support element, with said drive means automatically alternating between said stepping and said actuating.

10. The apparatus of claim 9 wherein said non-rigid support element is in the form of a film having a segment-mounting area for mounting the segment, with the film being supported by said rigid support element at locations displaced from said segment-mounting area.

11. The apparatus of claim 10 wherein said anvil means includes an anvil member, with said segment-mounting area being disposed between said anvil member and said breaker bar.

12. The apparatus of claim 11 wherein said rigid support means supports said film along substantially the entire periphery of said film.

13. The apparatus of claim 12 wherein said film includes an adhesive layer for securing the segment.

14. The apparatus of claim 13 wherein said anvil means includes an anvil member and said film is disposed between said breaker bar and said anvil member.

15. The apparatus of claim 14 wherein said anvil member includes a resilient pad for contacting the segment.

16. The apparatus of claim 15 wherein said anvil member is movable between a first position disposed proximate said segment mounting area and a second position displaced from said first position.

17. Apparatus for breaking a semiconductor wafer along a plurality of wafer scribe lines comprising:

support means for supporting the wafer, said support means including a relatively rigid support element and a relatively non-rigid support element;

breaker means for imparting a shock to the wafer along a first one of the wafer scribe lines through said relatively non-rigid support element so as to fracture the wafer along the first scribe line, said breaker means including a breaker bar having a knife-edge; and drive means for causing said breaker means to sequentially fracture the wafer along successive wafer scribed lines, with said drive means including stepper means for sequentially steeping the relative positions of the wafer and said breaker bar such that said knife-edge is disposed opposite each of the scribe lines and actuating means for actuating said breaker means thereby causing said breaker bar to impart said shock to the wafer.

18. The apparatus of claim 17 wherein said non-rigid element is in the form of a film.

19. The apparatus of claim 18 wherein said film includes a wafer mounting area for mounting the wafer and said rigid support element supports said film at locations displaced from said wafer mounting area.

20. The apparatus of claim 19 wherein said rigid support means supports said film along substantially the entire periphery of said film.

21. The appartus of claim 20 wherein said film includes an adhesive layer for securing the wafer.

22. The apparatus of claim 21 wherein said anvil means includes an anvil member and said film is disposed between said breaker bar and said anvil member.

23. The apparatus of claim 22 wherein said anvil member includes a resilient pad for contacting the wafer.

24. The apparatus of claim 23 wherein said anvil member is movable between a first position disposed proximate said wafer mounting area and a second position displaced from said first position.

* * * * *